US005205305A

United States Patent [19]

Yamakita

[11] Patent Number: 5,205,305

[45] Date of Patent: Apr. 27, 1993

[54] COLOR CHANGING SYSTEM FOR SPRAY DYEING

[75] Inventor: Yoshimichi Yamakita, Toyama, Japan

[73] Assignee: Yoshida Kogyo K.K., Tokyo, Japan

[21] Appl. No.: 775,089

[22] Filed: Oct. 11, 1991

[51] Int. Cl.[5] ..... B08B 3/04

[52] U.S. Cl. ..... 134/104.1; 134/167 C; 134/66 C; 68/13 R; 118/302; 239/112; 239/120

[58] Field of Search ..... 118/302, 70; 134/104.1, 134/166 C, 104.2, 182, 167 C; 68/205 R, 13 R; 101/425; 239/104, 110, 120, 112

[56] References Cited

U.S. PATENT DOCUMENTS

| | | | |
|---|---|---|---|
| 4,073,664 | 2/1978 | Zwirlein | 239/112 X |
| 4,204,977 | 5/1980 | Zwirlein | 239/112 X |
| 4,534,291 | 8/1985 | Sabota et al. | 101/425 X |
| 4,583,691 | 4/1986 | Smith | 239/112 |
| 4,722,273 | 2/1988 | Jahn | 101/425 X |
| 4,830,882 | 5/1989 | Ichinose et al. | 118/302 |
| 5,081,731 | 1/1992 | Yamakita et al. | 8/158 |

FOREIGN PATENT DOCUMENTS

| | | | |
|---|---|---|---|
| 0353963 | 2/1990 | European Pat. Off. . | |
| 0398126 | 11/1990 | European Pat. Off. . | |
| 56-150554 | 11/1981 | Japan | 101/425 |
| 925410 | 5/1982 | U.S.S.R. | 118/302 |
| 2083412 | 3/1982 | United Kingdom . | |

*Primary Examiner*—Frankie L. Stinson

*Attorney, Agent, or Firm*—Hill, Steadman & Simpson

[57] ABSTRACT

A color changing system for spray dyeing comprises a pair of washing tubs and a pair of spraying units. Each of the spray units includes a nozzle/nozzles, a feed pipe and a movable pipe. The spraying units are alternately operated to spray dye liquid onto a fabric strip, and are washed in the washing tubs to prepare for spraying new dye liquid onto the fabric strip.

1 Claim, 2 Drawing Sheets

COLOR CHANGING SYSTEM FOR SPRAY DYEING

BACKGROUND OF THE INVENTION

1. Field of the Invention

This invention relates to a spray dyeing process for continuously dyeing a long strip of fabric (hereinafter called as "fabric strip") such as a slide fastener chain, slide fastener tape, surface fastener, ribbon, and the like by spraying dye liquid thereto, and more particularly to a system for changing dye colors by washing spray nozzles without interrupting the spray dyeing process.

2. Description of the Related Art

This invention relates to improvement of the invention disclosed in Japanese Patent Laid-Open Publication 2-307960.

Heretofore the spray dyeing is well-known, in which dye liquid is sprayed onto a fabric strip. This spray dyeing is suitable to produce a good assortment of fabric strips in a small amount. The invention disclosed in the above Japanese Patent Laid-Open Publication relates to a method of washing spray nozzles for such spray dyeing, in which a pair of spraying units are used. When one of the spraying units is in operation, the nozzle of the other spraying unit is displaced from the fabric strip, so that the nozzles can be rinsed by washing liquid supplied thereto. Thus the fabric strip is sectionally dyed in different colors without interrupting the spray dyeing process.

With this spraying dyeing, the washing liquid is supplied to the nozzles to rinse them, then being discharged in the air. The washing liquid mixed with the dye liquid floats around the fabric strip, which might be stained while it is being conveyed.

SUMMARY OF THE INVENTION

It is therefore an object of this invention to provide a color changing system for the spray dyeing, in which the nozzles can be completely rinsed without staining the fabric strip and without interrupting the spray dyeing process.

According to this invention, there is provided a color changing system for spray dyeing, comprising: a pair of washing tubs filled with washing liquid; and at least a pair of spraying units. Each said spraying unit includes a feed pipe, a movable pipe and at least a nozzle. The feed pipe is switched to selectively supply dye liquid and washing liquid. The movable pipe is connected to an end of said feed pipe, and the nozzle being connected to said movable pipe and adapted to be moved between a spraying position and the washing tub so that the nozzle receives dye liquid via the feed pipe, sprays the dye liquid to a fabric strip, and is then moved into the washing tub to be washed by washing liquid supplied via the feed pipe to prepare for a next spraying process

DETAILED DESCRIPTION

Figure 1:
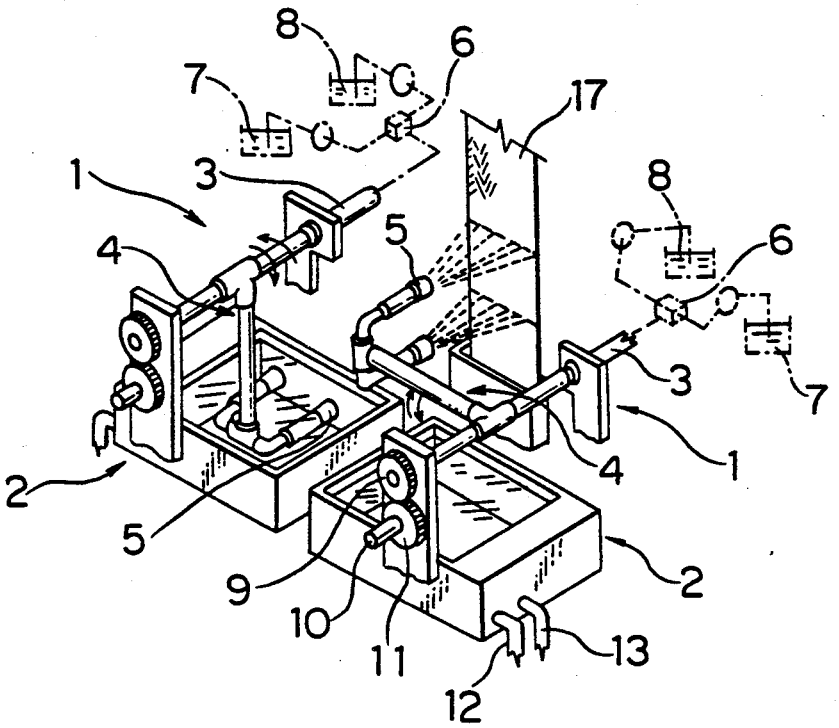
FIG. 1 is a schematic perspective view of a color changing system according to an embodiment of this invention.

One embodiment of the invention will be now described referring to the accompanying drawings.

A color changing system comprises a pair of dye spraying units 1, 1, and a pair of wash tubs 2, 2.

The dye spraying units 1, 1 are identical to each other. When one of the spraying units, 1, 1 is in operation, the other is being washed to enable it to spray dye liquid of a different color. The spraying units 1, 1 are alternately operated to spray-dye the fabric strip without interruption. Therefore, operation of only one of the units is described hereinafter.

The spraying unit 1 includes a pipe 3 for feeding either the dye or washing liquid, a movable pipe 4 communicating with the feed pipe 3, and nozzles 5 attached to one end of the movable pipe 4. The feed pipe 3 serves to supply the dye liquid and washing liquid to the nozzles 5, and is connected to a dye liquid tank 7 and a washing liquid tank 8 via a select valve 6 as indicated by dot-and-dash lines in FIG. 1.

The movable pipe 4 in the shape of T is movably connected to the other end of the feed pipe 3. The nozzles 5 is attached to the end of a branch at the central portion of the movable pipe 4. The other end of the movable pipe 4 terminates in a gear 9, which is in engagement with a gear 11 connected to a drive shaft 10. The drive shaft 10 is set in motion by a non-illustrated motor. The gears 9, 11 turn forwards and backwards according to the movement of the drive shaft 10, thereby moving the nozzles 5 upwards and downwards. The nozzles 5 is reciprocated between the dye spraying position to confront the fabric strip 17 and the washing tub 2 to be washed therein. The nozzles 5 alternately sprays the dye liquid to the fabric strip 17, and discharges the washing liquid in the wash tub 2.

Figure 2:
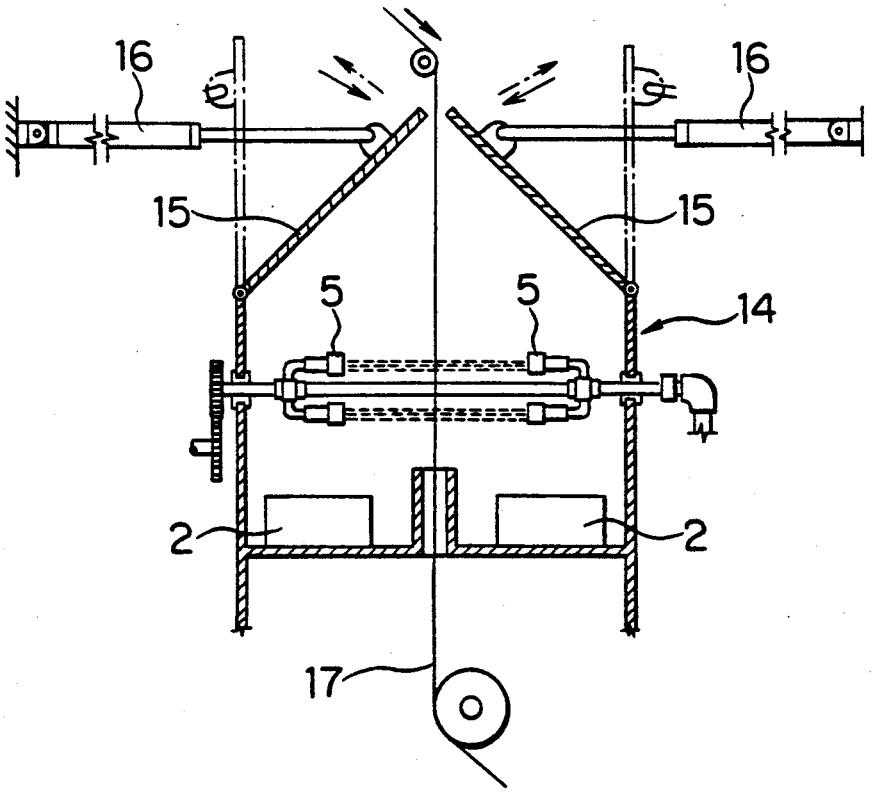
FIG. 2 is a cross-sectional view of the color changing system mounted in a dyeing chamber.

The nozzles 5 is arranged to confront the center line of the fabric strip which is continuously guided downwardly so that the dye liquid can be divergently and transversely sprayed onto the fabric strip 17. In the embodiment of FIG. 1, the nozzles 5 is vertically aligned. One or up to four nozzles may be used. The nozzles 5 may be arranged to spray the dye liquid onto either the front surface of the fabric strip 17 as shown in FIG. 1 or both front and rear surfaces of the fabric strip 17 as shown in FIG. 2.

Figure 3:
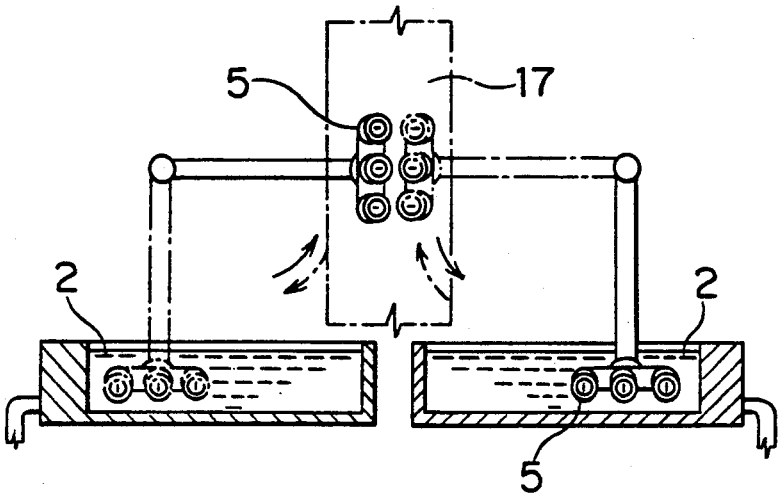
FIG. 3 is a front view showing a modified arrangement of nozzles.

FIG. 3 shows a modified arrangement of two nozzles of the pair of spraying units. Specifically, the nozzles 5 are placed to the spraying position to obliquely face the center line of the fabric strip 17, thereby enabling the nozzles to be moved promptly without interfering each other.

Figure 4:
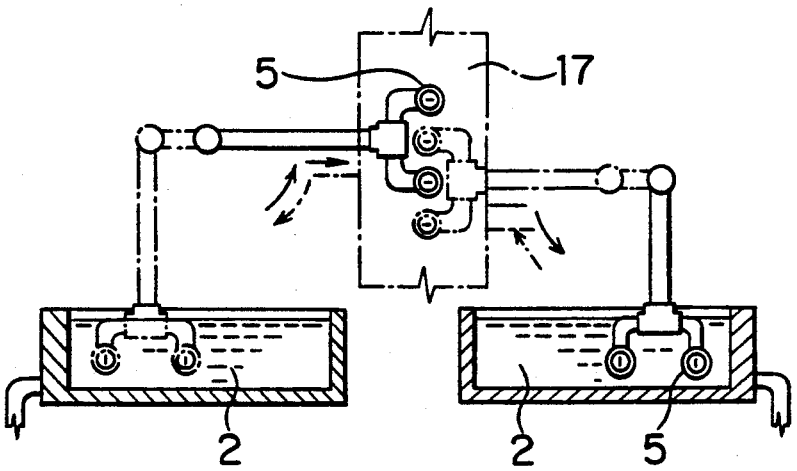
FIG. 4 is front view showing a still further modified arrangement of nozzles.

The nozzle pairs of the two spraying units may be alternately arranged as shown in FIG. 4. In this case, the nozzle pairs should be firstly withdrawn as indicated by straight arrows and then moved as indicated by oblique arrows.

The pair of washing tubs 2 are symmetrically arranged under the spraying units 1, 1 and the movable pipes 4, 4. The nozzles of the spraying unit 1 is moved downwardly into the washing tub 2 to be steeped and washed therein. Specifically, the outer surface of the nozzles 5 is washed in the washing tub 2, and the inner surfaces of the nozzles 5, the feed pipe 3 and the movable pipe 4 are rinsed by the washing liquid to be supplied via the select valve 6. The used washing liquid 4 is received in the washing tub 2. The washing tub 2 should be always filled with the washing liquid to sufficiently cover the nozzles 5 and not to be scattered when washing the nozzles 5. The amount of the washing liquid is controlled by a feed pipe 12 and a drainpipe 13.

With the embodiment of FIG. 1, two washing tubs 2 are respectively used for the pair of the spraying units 1, 1. It is also possible to use one large washing tub for both the spraying units 1, 1.

FIG. 2 shows the nozzles 5 and movable pipes 4 of the spraying units and the washing tubs 2 which are mounted in a dyeing chamber 14 to prevent dye mist from being dispersed outwardly. The dyeing chamber 14 has a pair of lids 15, 15, which are opened and closed by a pair of liquid pressure cylinders 16, 16. The lids 15, 15 are kept closed during the spray dyeing, being opened to suck the residual dye mist from the dye chamber 14 when different dye liquid is to be used subsequently. Thus, the dyed fabric strip 17 can be kept from being stained.

According to this invention, a pair of the spray units are associated with at least a washing tub, so that when one of the spray units is in operation, the other spray unit is standby with its nozzle(s) steeped in the washing tub(s). To dye the fabric strip in a different color, the spraying unit in operation is lowered while the nozzle(s) of the standby spraying unit is raised to the spraying position. Then new dye liquid is sprayed onto the fabric strip through the nozzle(s) of the other spray unit.

Not only the inner surfaces of the feed and movable pipe but also the nozzle pairs can be completely washed in the washing tubs. The washing liquid containing the dye liquid is kept in the washing tub, so that the dyed fabric strip can be dyed as desired without being stained. Units outside the spray units will not be also stained. The spray-dyed fabric strip is then color-developed by steam, color-fixed, washed, dried, and brought forward as a colored product.

At least a pair of the spraying units should be used according to this invention. Three or more spray units may be installed to perform dyeing and washing alternately. A plurality of long strips of fabric such as slide fastener tapes may be guided in rows to be spray-dyed simultaneously.

With this invention, the spray dyeing is performed by a pair of the spraying units and at least a washing tub. The spraying units are alternately used so that when one of them is in operation, the other unit is standby in the washing tub where the outer and inner surfaces of the feed and movable pipes as well as the nozzle(s) are washed. The liquid for washing these components is kept in the washing tub not to be dispersed in the air as mist. Therefore, the dyed fabric strip will not be stained, and new dye liquid can be sprayed via the washed nozzles to dye the fabric strip clearly and beautifully.

What is claimed is:

1. A color changing system for spray dyeing; comprising:

(a) at least a washing tub filled with a washing liquid;

(b) a source of dye liquid;

(c) a source of washing liquid; and (d) at least a pair of spraying units, each spraying unit including a feed pipe, a movable pipe and at least a nozzle, said feed pipe having valve means for selectively switching between the source of dye liquid and the source of washing liquid, said movable pipe being connected to an end of said feed pipe, and said nozzle being connected to said movable pipe, means for rotating said movable pipe to move said nozzle between a spraying position and a washing position immersed in the washing liquid of said washing tub, and valve means for supplying said nozzle with dye liquid via said feed pipe when in said spray position and for supplying said nozzle with washing liquid via said feed pipe when in said washing position.

* * * * *